US008459065B2

(12) United States Patent
Sung

(10) Patent No.: US 8,459,065 B2
(45) Date of Patent: Jun. 11, 2013

(54) DRUM TYPE WASHING MACHINE AND HOUSING THEREOF

(75) Inventor: Jong Hun Sung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/926,645

(22) Filed: Dec. 1, 2010

(65) Prior Publication Data

US 2011/0132042 A1 Jun. 9, 2011

(30) Foreign Application Priority Data

Dec. 8, 2009 (KR) ..... 10-2009-0121241

(51) Int. Cl.
*D06F 39/14* (2006.01)

(52) U.S. Cl.
CPC ..... *D06F 39/14* (2013.01)
USPC ..... 68/3 R; 68/12.26

(58) Field of Classification Search
CPC . D06F 39/14; D06F 37/26; D06F 37/28; D06F 37/42; D06F 2224/00
USPC ..... 68/140, 3 R, 12.26, 196
See application file for complete search history.

(56) References Cited

U.S. PATENT DOCUMENTS

| | | | | |
|---|---|---|---|---|
| 6,082,787 | A * | 7/2000 | Chioffi et al. | 292/128 |
| 2006/0112498 | A1* | 6/2006 | Roh et al. | 8/158 |
| 2007/0017258 | A1* | 1/2007 | Son et al. | 68/3 R |
| 2008/0231061 | A1* | 9/2008 | Rocchitelli | 292/303 |
| 2009/0167126 | A1* | 7/2009 | Yoon | 312/326 |

FOREIGN PATENT DOCUMENTS

| | | |
|---|---|---|
| DE | 102009002776 | 11/2010 |
| EP | 1 972 715 | 9/2008 |
| KR | 10-2005-0111043 | 11/2005 |

OTHER PUBLICATIONS

European Search report dated May 11, 2011, issued in European Patent Application No. 10193224.2.

* cited by examiner

*Primary Examiner* — Joseph L Perrin
(74) *Attorney, Agent, or Firm* — Staas & Halsey LLP

(57) ABSTRACT

A drum type washing machine including a housing having an introduction port, a door to open and close the introduction port, a locking member provided at the door, a locking device provided at the housing to lock the locking member. The locking device has a first through hole and a first support extending from the perimeter of the first through hole. The housing has a second support extending from the perimeter of a second through hole, through which the first support is inserted, to support the outside of the first support in a plane contact state. The first support is prevented from being damaged due to impact during transportation.

7 Claims, 5 Drawing Sheets

DRUM TYPE WASHING MACHINE AND HOUSING THEREOF

CROSS-REFERENCE TO RELATED APPLICATIONS

This application claims the benefit of Korean Patent Application No. 2009-0121241, filed on Dec. 8, 2009 in the Korean Intellectual Property Office, the disclosure of which is incorporated herein by reference.

BACKGROUND

1. Field

Embodiments relate to a drum type washing machine having a locking device to maintain a state in which a door to open and close an introduction port is closed and a housing thereof.

2. Description of the Related Art

Generally, a drum type washing machine is an apparatus that repeatedly performs washing and rinsing cycles to wash laundry. The laundry is lifted and dropped, with the result that the laundry is washed.

The drum type washing machine includes a housing forming the external appearance thereof, the housing having an introduction port through which laundry is introduced, a water tub mounted in the housing in a suspended manner to contain wash water, a cylindrical rotary tub rotatably mounted in the water tub such that a shaft of the rotary tub is disposed in a frontward-and-backward direction to receive laundry, and a door hingedly coupled to the housing at one side of the introduction port to open and close the introduction port.

In the drum type washing machine, the door is installed at the front of the water tub, with the result that, when the door is opened in a state in which the water tub is filled with wash water, the wash water may pour out through the introduction port. For this reason, the drum type washing machine has a locking device to maintain a state in which the introduction port is closed by the door when wash water is contained in the drum type washing machine. Correspondingly, the door has a locking member configured to be locked by the locking device.

SUMMARY

It is an aspect to provide a drum type washing machine that is prevented from being damaged due to impact which may be generated during transportation.

Additional aspects will be set forth in part in the description which follows and, in part, will be apparent from the description, or may be learned by practice of the invention.

In accordance with one aspect, a drum type washing machine includes a housing having an introduction port, a door to open and close the introduction port, a locking member provided at the door, a locking device provided at the housing to lock the locking member, a first through hole formed in the locking device, a second through hole formed in the housing such that the second through hole corresponds to the first through hole, a first support extending from the perimeter of the first through hole such that the first support is supported by the inside of the first through hole, and a second support extending from the perimeter of the second through hole to support the outside of the first support in a plane contact state.

The second support may integrally extend from a front panel forming the front of the housing.

The first through hole and the second through hole may be formed in a quadrangular shape, and the first support may have a sectional form of a quadrangular ring having an outside corresponding to the inside of the second through hole.

The second support may have a sectional form of a quadrangular ring having an inside corresponding to the outside of the first support.

The second support may be formed in a shape corresponding to a lower part of the outside of the first support to support the lower part of the outside of the first support.

In accordance with another aspect, a housing of a drum type washing machine includes a second through hole, through which a first support, having a first through hole provided therein, formed at a locking device is inserted, and a second support extending from the perimeter of the second through hole to support the outside of the first support in a plane contact state.

The outside of the first support may be formed in a quadrangular shape, and the second support may have a sectional form of a quadrangular ring having an inside corresponding to the outside of the first support.

The second support may be formed in a shape corresponding to a lower part of the first support to support the lower part of the first support.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
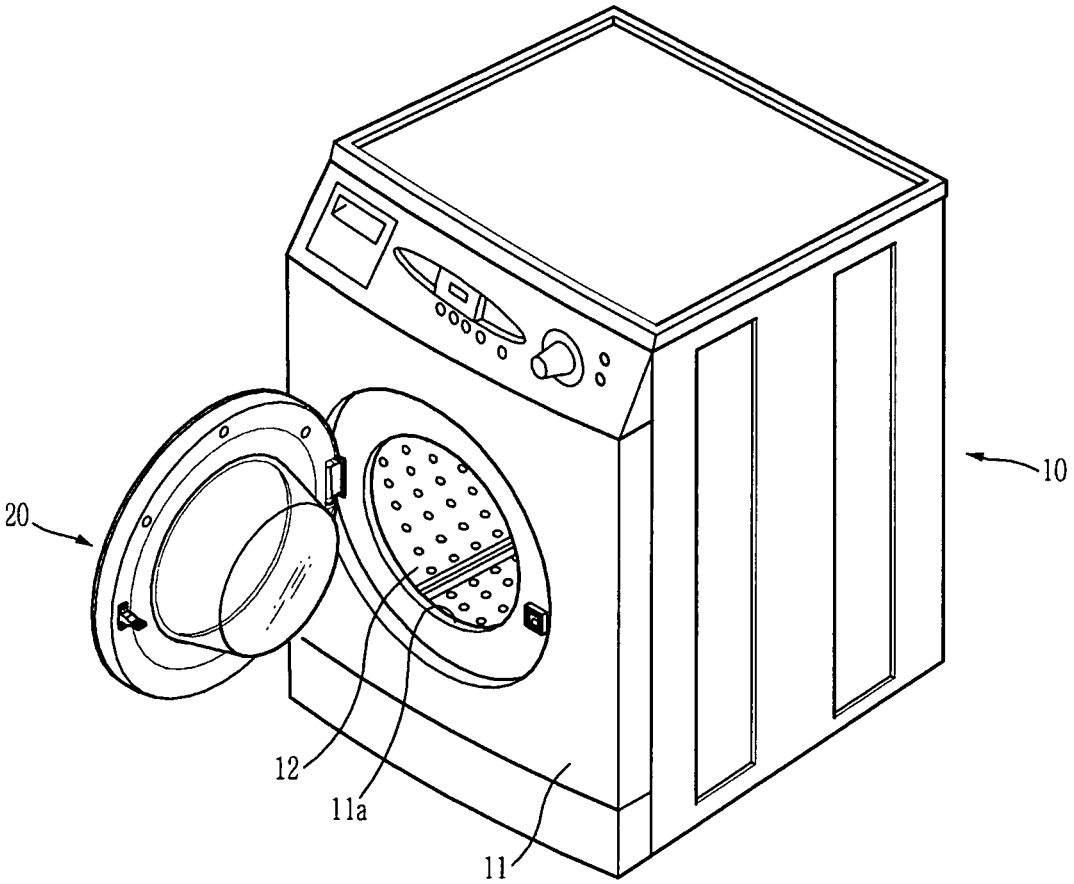
FIG. 1 is a perspective view illustrating a drum type washing machine according to an embodiment.

Reference will now be made in detail to the embodiments, examples of which are illustrated in the accompanying drawings, wherein like reference numerals refer to like elements throughout.

As shown in FIG. 1, a drum type washing machine according to an embodiment includes a housing 10 forming the external appearance thereof, a water tub (not shown) mounted in the housing 10 in a suspended manner to contain water, and a rotary tub 12 rotatably mounted in the water tub. With the rotation of the rotary tub 12, laundry in the rotary tub 12 is lifted and dropped, with the result that the laundry is washed.

A front panel 11 forming the front of the housing 10 has an introduction port 11*a* through which laundry is introduced into the rotary tub 12. The introduction port 11*a* is opened and closed by a door 20. One side of the door 20 is hingedly coupled to the front panel 11 at one side of the introduction port 11*a*.

Figure 2:
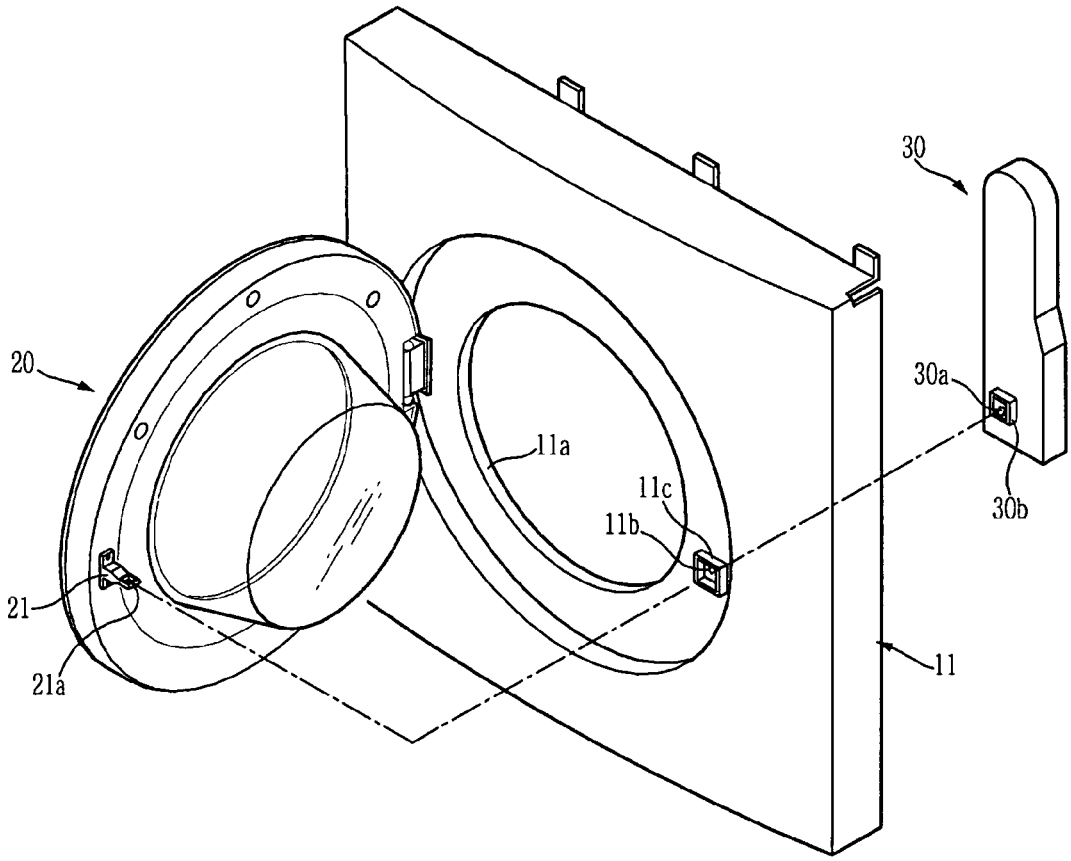
FIG. 2 is a perspective view illustrating a locking device and a locking member according to an embodiment.

As shown in FIG. 2, a locking member 21 protrudes backward from the rear of the door 20 at the other side of the door 20 to maintain a state in which the introduction port 11*a* is closed by the door 20. A locking device 30 is mounted at the rear of the front panel 11 of the housing 10 to lock the locking member 21 such that the state in which the introduction port 11*a* is closed by the door 20 is maintained.

Figure 3:
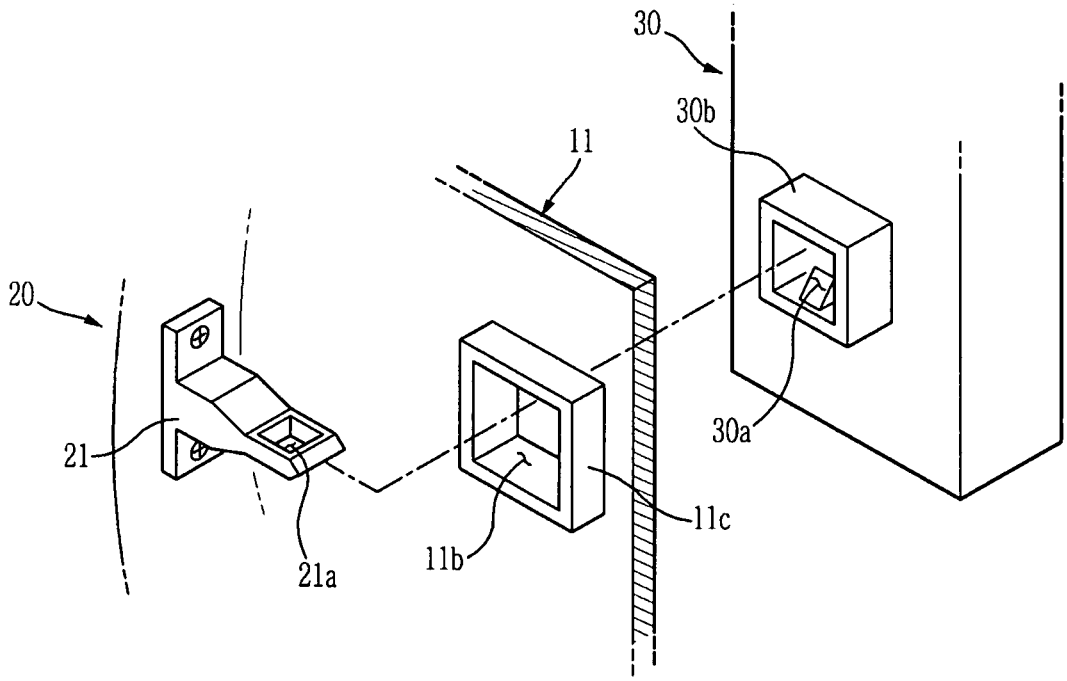
FIG. 3 is an enlarged view of the locking device and the locking member.
Figure 4:
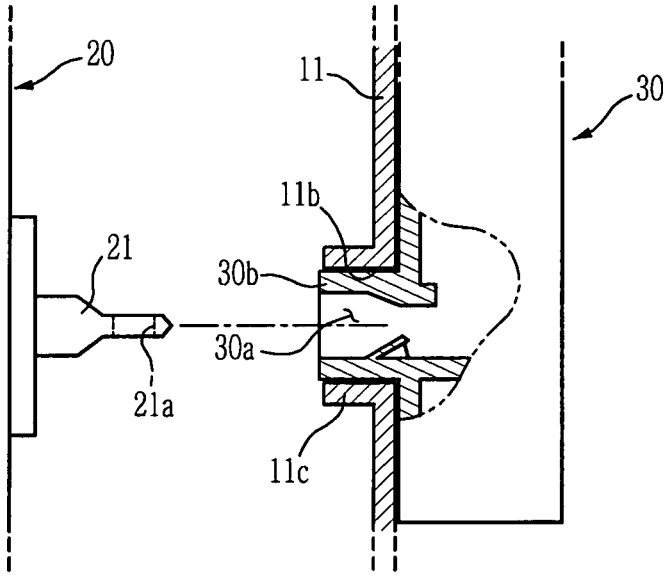
FIG. 4 is a sectional view illustrating the coupling between the locking device and the locking member.

As shown in FIGS. 3 and 4, the locking member 21 is provided at the rear end thereof with a locking hole 21*a*, by which the locking device 30 is locked. When the rear end of the locking member 21 is inserted into the locking device 30, a hook (not shown) of the locking device 30 is locked in the locking hole 21*a*.

The locking device 30 is provided at the front thereof with a first through hole 30*a*, through which the rear end of the locking member 21 is inserted into the locking device 30. In the front panel 11 at the other side of the introduction port 11*a* is formed a second through hole 11*b*, through which the locking member 21 is inserted into the locking device 30.

The first through hole 30*a* and the second through hole 11*b* are located at exactly corresponding positions such that the rear end of the locking member 21 is inserted into the locking device 30 through the first through hole 30*a* and the second through hole 11*b*. To this end, the locking device 30 has a first support 30*b* integrally extending from the perimeter of the first through hole 30*a* such that the first support 30*b* is supported by the inside of the second through hole 11*b*. The outside of the first support 30*b* corresponds to the inside of the second through hole 11*b* to maintain a state in which the first through hole 30*a* and the second through hole 11*b* are located at the corresponding positions. Therefore, the outside of the first support 30*b* is supported by the inside of the second through hole 11*b*.

The first support 30*b* may have a protruding length equal to the thickness of the front panel 11. Since the front panel 11 is made of a thin iron plate, however, the first support 30*b* may be separated from the second through hole 11*b* when external impact is applied to the drum type washing machine during transportation or installation. For this reason, the first support 20*b* protrudes frontward through the second through hole 11*b* in order to stably maintain a state in which first support 30*b* is supported by the inside of the second through hole 11*b*.

Also, the front panel 11 of the housing 10 has a second support 11*c* integrally extending from the perimeter of the second through hole 11*b* to prevent the first support 30*b* from being damaged due to local concentration of external impact on the first support 30*b* when the external impact is applied to the drum type washing machine. The inside of the second support 11*c* corresponds to the outside of the first support 30*b* such that the inside of the second support 11*c* is in plane contact with the outside of the first support 30*b*. If external impact is applied to the drum type washing machine, therefore, the external impact is dispersed on the outside of the first support 30*b* by the second support 11*c*, thereby preventing damage to the first support 30*b*.

In this embodiment, the first through hole 30*a* and the second through hole 11*b* are formed in a quadrangular shape. Correspondingly, the first support 30*b* is formed in the shape of a quadrangular ring, the outside of which corresponds to the inside of the second through hole 11*b*, and the second support 11*c* is formed in the shape of a quadrangular ring, the inside of which corresponds to the outside of the first support 30*b*.

Figure 5:
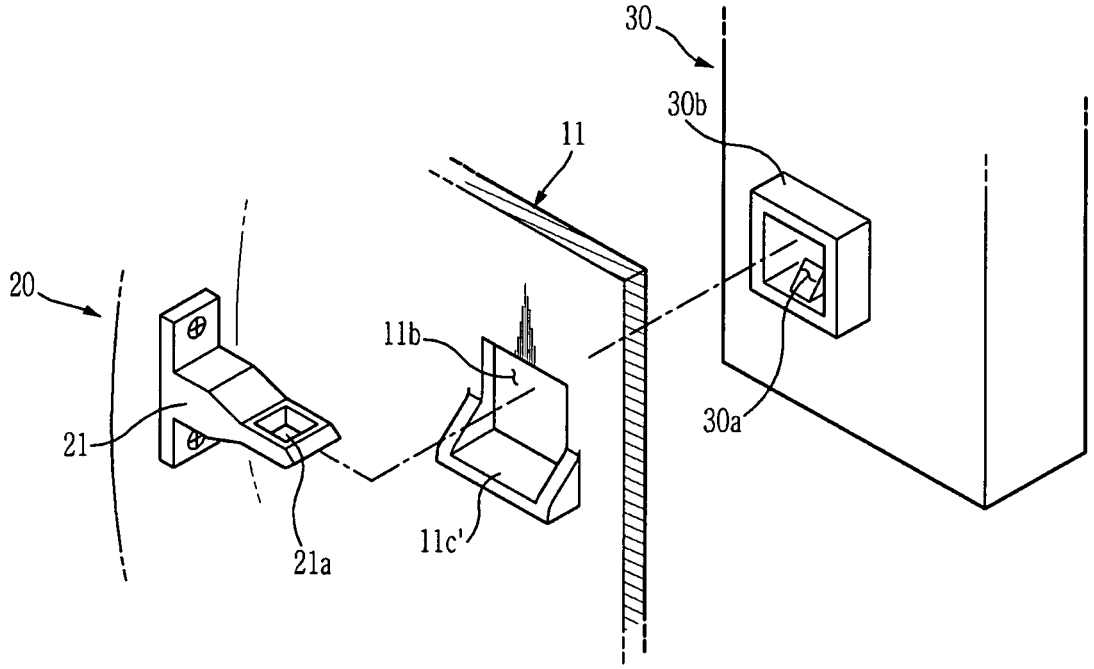
FIG. 5 is a perspective view illustrating a locking device and a locking member according to another embodiment.

However, the structure of the second support 11*c* is not limited to the above embodiment. As shown in FIG. 5, for example, a second support 11*c*' may be formed in a shape corresponding to a lower part of the outside of the first support 30*b* to restrictively support the outside of the first support 30*b*. The lower part of the first support 30*b* may be supported by the second support 11*c*' since impact generated during transportation is mainly applied to the lower part of the second support 11*c*'.

As is apparent from the above description, the first support of the locking device is supported by the second support in a plane contact state. Although impact is applied to the drum type washing machine, therefore, such impact is dispersed on the first support, thereby preventing damage to the first support.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A drum type washing machine comprising:

a housing having an introduction port, a door to open and close the introduction port;

a locking member provided at the door;

a locking device provided at the housing to lock the locking member;

a first through hole formed in the locking device;

a second through hole formed in the housing such that the second through hole corresponds to the first through hole;

a first support extending from a perimeter of the first through hole such that the first support is supported by an inside of the first through hole; and a second support frontwardly extending from at least a portion of a perimeter of the second through hole to support an outside of the first support, wherein the first through hole and the second through hole are formed in a quadrangular shape, and the first support has a sectional form of a quadrangular ring having an outside corresponding to an inside of the second through hole.

2. The drum type washing machine according to claim 1, wherein the second support integrally extends from a front panel forming a front of the housing.

3. The drum type washing machine according to claim 1, wherein the second support has a sectional form of a quadrangular ring having an inside corresponding to the outside of the first support.

4. The drum type washing machine according to claim 1, wherein the second support is formed in a shape corresponding to a lower part of the outside of the first support to support the lower part of the outside of the first support.

5. The drum type washing machine according to claim 1, where the second support extends from a lower portion of the perimeter of the second through hole.

6. A housing of a drum type washing machine, comprising:

a second through hole, through which a first support, having a first through hole provided therein, the first through hole accommodating insertion of a locking device, and a second support frontwardly extending from a perimeter of the second through hole to support an outside of the first support in a plane contact state, wherein the second support is formed in a shape corresponding to a lower part of the first support to support the lower part of the first support, and wherein the outside of the first support is formed in a quadrangular shape, and the second support has a sectional form of a quadrangular ring having an inside corresponding to the outside of the first support.

7. The housing according to claim 6, wherein the first support has a protruding length equal to a thickness of a front panel of the housing, the front panel being made of an iron plate.

* * * * *